United States Patent [19]

Hughes et al.

[11] 4,315,664

[45] Feb. 16, 1982

[54] MODULAR JACK

[75] Inventors: Donald W. K. Hughes, Mechanicsburg; Ronald W. Myers, Landisburg, both of Pa.

[73] Assignee: AMP Incorporated, Harrisburg, Pa.

[21] Appl. No.: 146,808

[22] Filed: May 5, 1980

[51] Int. Cl.[3] ..... H01R 4/24; H01R 13/514

[52] U.S. Cl. ..... 339/176 M; 339/97 R

[58] Field of Search ..... 339/97–99, 339/176 M, 126, 276 SF

[56] References Cited

U.S. PATENT DOCUMENTS

| | | | |
|---|---|---|---|
| 3,850,497 | 11/1974 | Krumreich et al. | 339/126 R |
| 4,159,158 | 6/1979 | Weidler | 339/97 P |
| 4,210,376 | 7/1980 | Hughes et al. | 339/176 M X |
| 4,261,633 | 4/1981 | Abernethy | 339/126 R X |

*Primary Examiner*—Eugene F. Desmond

*Attorney, Agent, or Firm*—Frederick W. Raring

[57] ABSTRACT

Modular jack-type connector receptacle comprises an insulating housing having a rearward end and having a ledge extending beyond the rearward end from one of the housing sidewalls. The conductors are stamped and formed members which extend through channels in the external sidewall and through openings and into the plug-receiving opening of the housing. A plurality of side-by-side stalls are provided on the ledge and the conductors extend into these stalls, each conductor having a slotted plate-type wire-receiving means on its end locating within one of the stalls. Wires can be connected to the stamped and formed conductors by supporting the underside of the ledge on a suitable anvil and inserting the wires into the wire-receiving portions.

4 Claims, 6 Drawing Figures

MODULAR JACK

FIELD OF THE INVENTION

This invention relates to electrical connector receptacles of the type commonly referred to as "modular jacks" and particularly to an improved receptacle having means permitting direct attachment of individual wires to the conductors on the receptacle.

BACKGROUND OF THE INVENTION

U.S. Pat. No. 3,850,497 describes in detail a connector receptacle, commonly referred to as a modular jack, of a type which is intended for use in the telephone industry. The receptacle described in this patent comprises an insulating housing having a plug-receiving end and a plug-receiving opening extending into the plug-receiving end. A plurality of circular openings extend through the housing from the plug-receiving end to the rearward end of the housing and contact springs extending from these circular openings diagonally into the plug-receiving opening so that when a plug is inserted into the receptacle, the contact members on the plug will engage the contact springs. The contact springs are in the form of wires and are connected by means of crimped electrical connections to lead wires. These crimped connections are contained in the circular openings in the housing and the lead wires extend from the circular openings and away from the housing at the rearward end thereof. THe commonly used type of connector plug which is intended to be mated with connector receptacles of the type described above is described in U.S. Pat. No. 3,954,320.

U.S. Pat. No. 4,193,654 is representative of a later generation of modular jacks having stamped and formed conductors, rather than drawn wire conductors. The use of stamped and formed conductors in modular jacks offers several advantages; for example, when gold plating is required on the conductors, the gold can be plated only on the contact area of each conductor by well-known plating techniques, whereas, wire conductors must be plated over their entire lengths. By virtue of this fact, very substantial savings in plating costs are realized in the use of stamped and formed conductors rather than wire conductors. Additionally stamped and formed sheet metal conductors provide more contact area for engagement with a complementary modular plug and stamped conductors can be assembled to the receptacle housing more easily than can drawn wire conductors. A variety of types of modular jacks are available having stamped and formed conductors therein, in addition to the type shown in the above identified U.S. Pat. No. 4,193,654.

The available modular jacks which are provided within stamped and formed conductors are all intended for direct mounting on a circuit board and accordingly, they have post portions which extend beyond the jack housing and which are intended for reception in circuit board holes so that they can be soldered to conductors on the circuit board. It would be desirable, however, to have available a modular jack-type receptacle which can be used with insulated wires such that insulated wires can be connected to the conductors of the receptacle as shown in U.S. Pat. No. 3,850,495. While it is known to provide wire-receiving plate means on conductors in an electrical receptacle, it has not been practical heretofor to provide wire-connecting means on modular jack-type receptacles for a variety of reasons.

Modular jacks are relatively small and space considerations alone present substantial problems. Further more, when wires are inserted into the wire-receiving portions of conductors or terminals in a connector housing, a substantial compressive force may be imposed on the housing as the result of the wire-receiving operation and modular jack-type housings could be damaged by the imposition of such forces.

In accordance with the present invention, a modular jack type receptacle is provided which is capable of having its conductors connected directly to individual insulated wires without the necessity of using crimped connections between the jack conductors and the insulated wires as taught by U.S. Pat. No. 3,850,497. The modular jack, in accordance with the invention, has an integral ledge extending beyond one of the external sidewalls of the jack housing and overhanging the rearward end of the jack housng. A plurality of open top stalls are provided on this ledge and the conductors have wire-receiving portions contained in these stalls. Wires are connected to the individual conductors of the receptacle by aligning a wire with each stall and moving the wires into the stalls and into the conductor-receiving portions of the terminals. During such movement of the wires, the receptacle housing is supported on an anvil which has a support surface extending beneath the ledge so that the forces imposed during the insertion operation are transmitted to the anvil and are not borne by critical portions of the receptacle housing.

PRACTICE OF THE INVENTION

Figure 1:
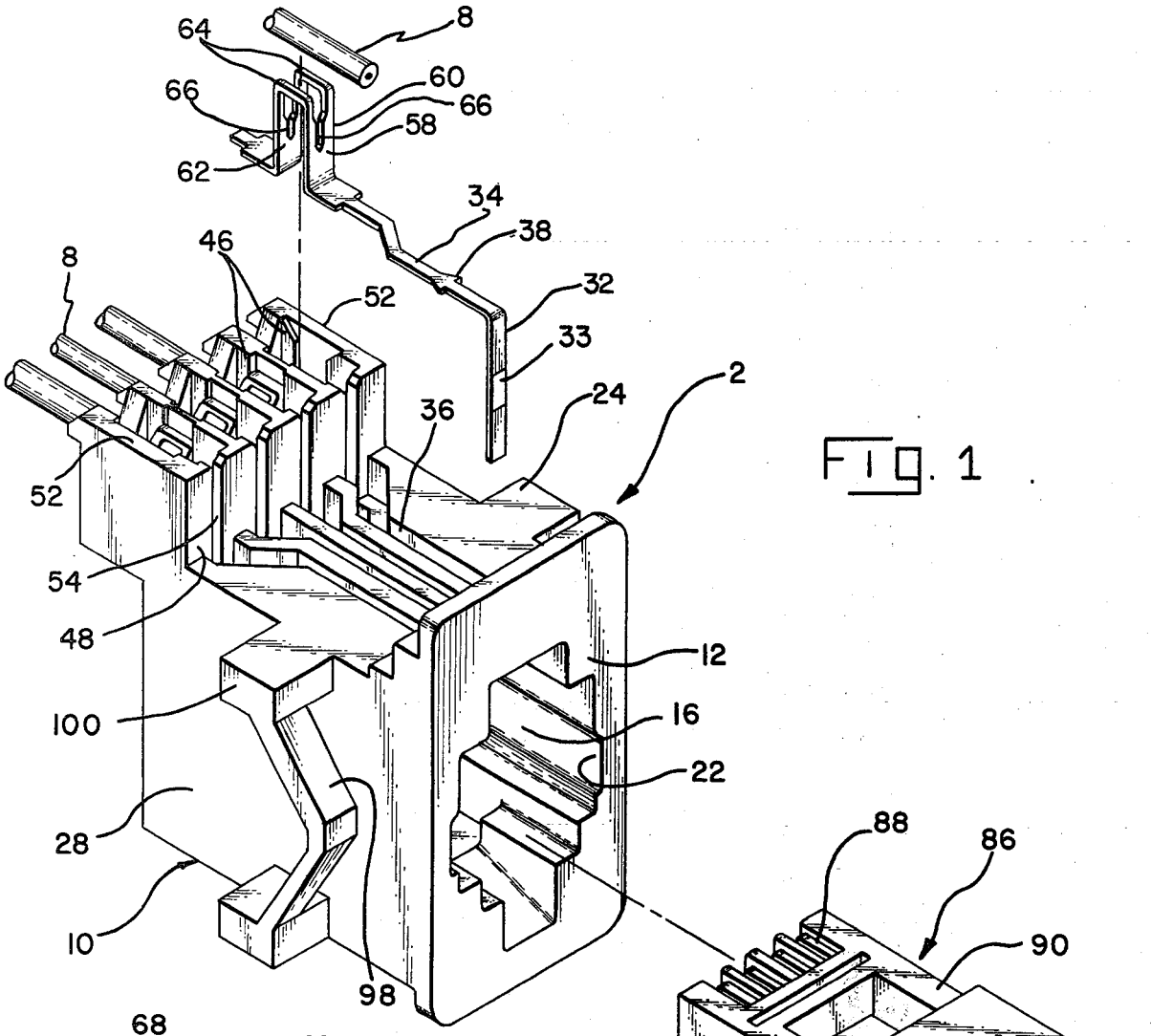
FIG. 1 is a perspective view of a modular jack-type receptacle in accordance with the invention, with a complementary plug in alignment with the housing.

A modular jack-type receptacle 2 in accordance with the invention, serves to connect conductors 4 contained in a cable 6 to individual insulated conductors 8. The cable 6 has a plug 86 on its end which, when mated with the receptacle, contacts individual conductors in the receptacle 2 which in turn are connected to the wires 8, as will be described below.

The receptacle 2 comprises a one-piece housing 10 molded of a suitable material, such as polyester, having a plug-receiving end 12, a rearward end 14, and a plug-receiving opening 16 which extends into the plug-receiving end. The opening has upper and lower (as viewed in the drawing) opposed internal sidewalls 18, 20 and opposed endwalls 22, The housing has upper and lower external sidewalls 24, 26, and laterally facing endwalls 28 which are adjacent to the internal endwalls 22.

The individual stamped and formed conductors 30 are of a conductive material having suitable spring properties, such as phosphor bronze, and each conductor has a contact spring portion 32, an adjoining intermediate portion 34 and a wire-receiving portion 58. The contact spring portion may be provided with a narrow band 33 of electrodeposited conductive plating material, such as gold. The intermediate portions 34 of the conductors are disposed in narrow channels 36 which extend rearwardly on the sidewall 24 towards stalls 46 described below and the conductors are retained in these channels by barbs 38 which extend from the side edges of the conductors. Each conductor extends through an opening 40 at the end of its respective channel 36 and is reversely bent, as shown at 42 so that the contact spring portion 32 extends diagonally into the opening 16 and towards the rearward end of the housing.

Figure 2:
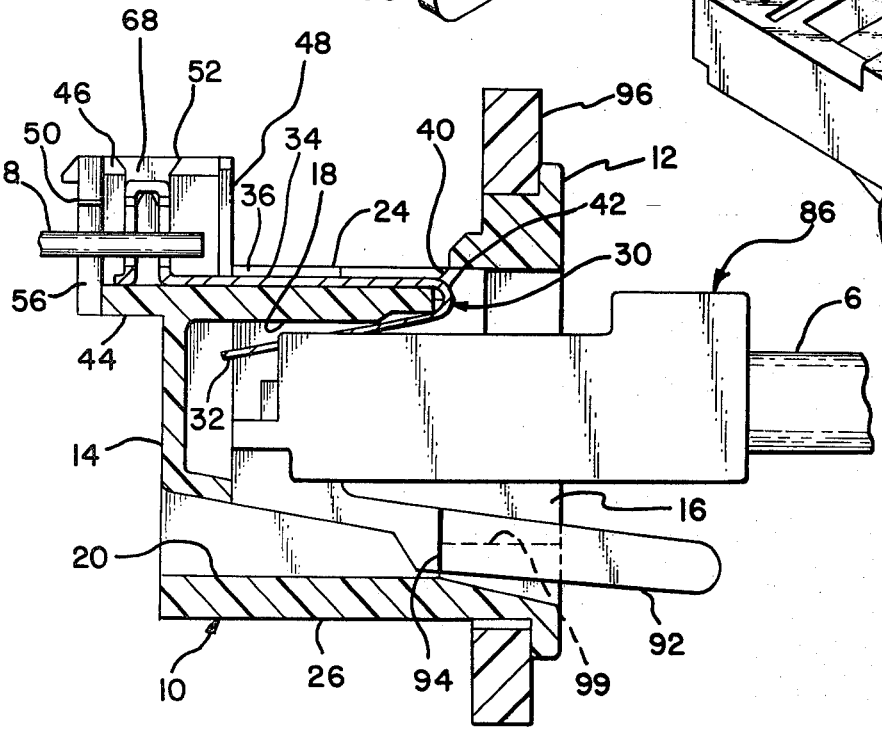
FIG. 2 is a cross-sectional view of the jack receptacle mounted in a panel and a complementary plug.

An integral ledge 44 is provided on the housing as an extension of the top wall thereof and overhangs the rearward end 14 of the housing, as best shown in FIG. 2. A plurality of side-by-side stalls 46 are provided on the upper surface of this ledge, these stalls being open at their upper ends and having front walls 48 which face forwardly, and rearwardly facing rear walls 50, the adjacent stalls being separated from each other by barrier walls 52. Slots are provided in the front walls and the rear walls, as shown at 54, 56 to permit assembly of the conductors to the housing and later connection of wires 8 to the individual conductors.

The wire-receiving portions 58 of the conductors are relatively wider, as is apparent from FIG. 1, than the intermediate and contact spring portions and comprise a pair of plate-like sections 60, 62 which extend upwardly from the intermediate portions and which are connected to each other at their upper ends by spaced-apart integral straps 64. Wire-receiving slots 66 extend downwardly in the two plate-like sections and are dimensioned to receive an individual wire 8 in a manner such that during movement of the wire into the slots, the insulation of the wire will be penetrated and contact will be established with the conducting core.

Figure 3:
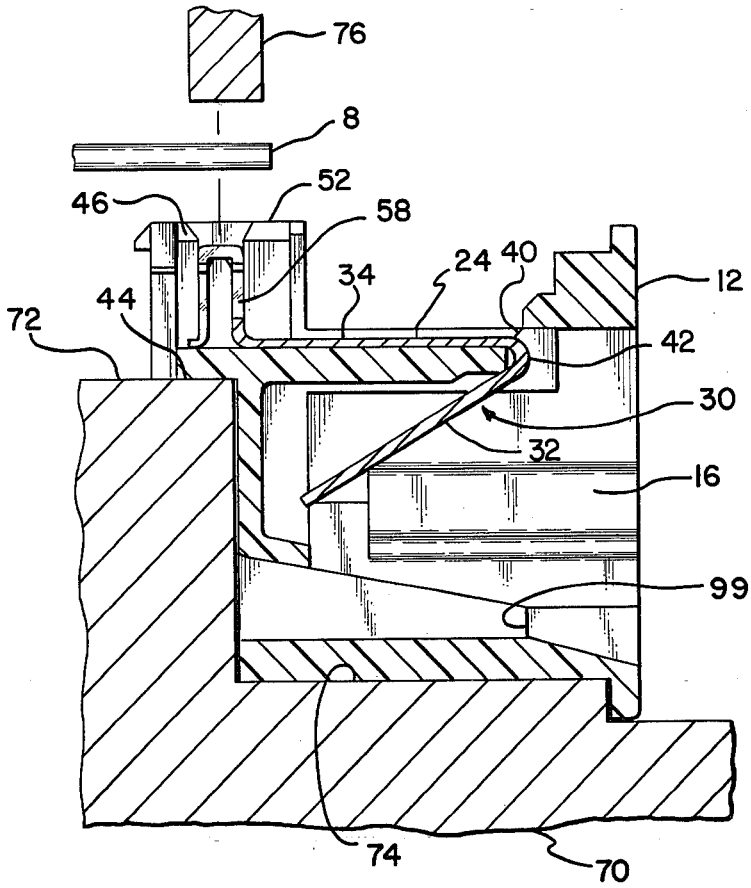
FIG. 3 is a cross-sectional view illustrating the insertion of a wire into the wire-receiving portion of a terminal in the housing.

FIG. 3 shows the manner of connecting individual wires 8 to the conductors by means of tooling comprising a supporting anvil 70 and insertion punch means 76. The receptacle is supported on surfaces 72, 74 of the anvil, the surface 72 being beneath the ledge 44 so that when the wire is pushed into the wire-receiving portion of the terminal, the forces will be transmitted to the anvil and will not damage the critical portions of the receptacle housing.

The wires can be inserted individually into the conductor-receiving portions 58 of the conductors or, preferably, they can be inserted by suitable mass insertion devices capable of inserting a plurality of wires during a single insertion stroke. For example, wired modular receptacles can be produced by simply feeding a succession of modular jack receptacles to an automatic machine having means for locating the wires in alignment with the conductor-receiving portions in the receptacles and having means for inserting the wires into the terminals. Machines of this type, as generally disclosed in U.S. Pat. No. 4,043,017, are widely used and can be adapted to insert wires into jack-type receptacles.

Figure 4:
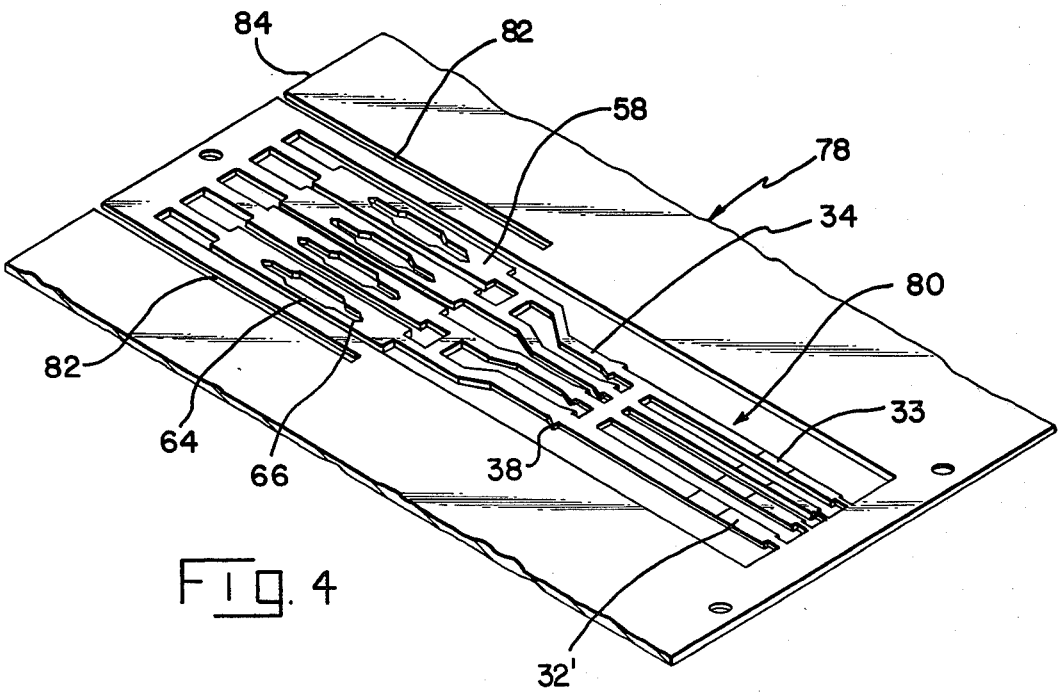
FIG. 4 is a fragmentary plan view of sheet metal blank from which conductors for the receptacles are formed.
Figure 5:
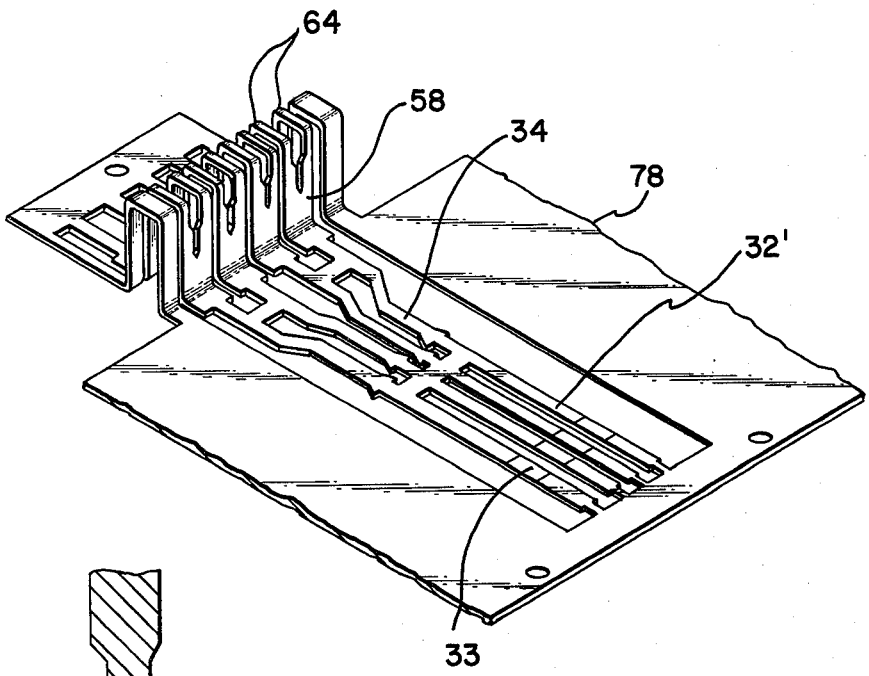
FIG. 5 is a perspective view of a group of the conductors after forming.
Figure 6:
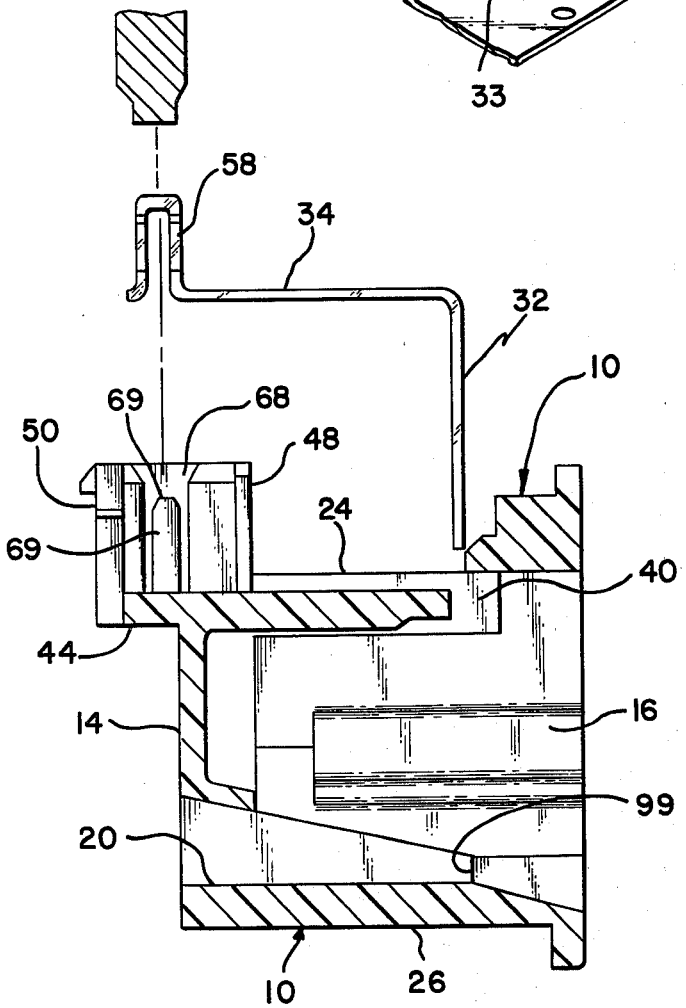
FIG. 6 is a cross-sectional view illustrating the manner of assembling the conductors to the housing.

As shown in FIGS. 4 and 5, the conductors 30 are produced in continuous strip from 78 by stamping groups 80 of conductor blanks, the number of individual blanks in each group being equal to the number required for a single housing and with the conductor blanks shaped to enter the channels 36 in the housing. In FIG. 4, the parts of the blanks are identified with the same reference numerals, differentiated by prime marks, as are used in the description of the formed conductors. In order to permit formation of the wire receiving portions 58 of the conductors, slots 82 are formed beside each set of blanks extending inwardly from the edge 84 of the strip and past those portions of the blanks which are formed into the wire-receiving portions. The wire-receiving portions are formed by U-ing the strip, as shown in FIG. 5, and the individual sets of conductors can then be assembled to the housing, as shown in FIG. 6. The contact spring portions are formed downwardly so that the conductors of the entire set can be pushed downwardly from the position of FIG. 6 until the contact spring portions extend through the openings 40 and the wire-receiving portions are received in the recesses 46 in the separator walls 52. When a plug 86 is first inserted into the plug-receiving opening, the contact spring portions will be bent rearwardly so that when the plug is later removed the spring portions will be in the positions shown in FIG. 2.

Advantageously, centrally located shoulders 69 are provided in the recesses 46 against which the strap portions 64 bear when the conductors are assembled to the housing. These shoulders serve to support the strap portions and thereby support the entire wire-receiving portions of the conductors when the wires are inserted.

The plug 86 on the end of the cable 6 has a plurality of stamped terminals 88 therein at its leading end which engage the contact spring portions 32 of the receptacle conductors. The plug has a latch arm 92 extending rearwardly on its underside which has spaced-apart rearwardly facing shoulders 94 thereon. Shoulders 94 engage shoulders 99 in the housing when the plug is inserted, as shown in FIG. 2.

The particular embodiment of the invention shown is intended to be mounted in an opening in a panel 96 and has resilient retaining springs 98 integral with its external endwalls 28. These retaining springs are integral with bosses 100 adjacent to the upper and lower sidewalls of the housing and are dimensioned such that when a housing is placed in the panel opening, the arms will be deflected and will retain the housing in its mounted position.

I claim:

1. An electrical connector receptacle of the type comprising an insulating housing having a plug-receiving end and a rearward end, a plug-receiving opening extending into said plug-receiving end, said opening having opposed internal sidewalls and adjacent external sidewalls, and opposed internal endwalls, a plurality of stampd and formed electrical conductors mounted on said housing, each of said conductors comprising an intermediate portion and a contact spring portion, said contact spring portion extending from one of said internal sidewalls at a location adjacent to said plug-receiving end diagonally into said opening and towards the opposite internal sidewall, said intermediate portions of said conductors being inserted into side-by-side channels in the external sidewall which is adjacent to said one internal sidewall, said channels extending across said adjacent external sidewall towards said rearward end, said connector receptacle being characterized in that:

said adjacent external sidewall extends beyond said rearward end and forms a ledge which overhangs said rearward end, a plurality equal to the number of said conductors, of open top stalls on said ledge, said stalls having front and rear stall sidewalls which face forwardly and rearwardly of said housing, each of said rear stall sidewalls having a wire admitting slot therein, said intermediate portions of said conductors extending into said stalls, each of said conductors having an upstanding plate-like means in its respective stall, each plate-like means having a wire-receiving slot means therein which is receptive to a wire upon movement of said wire laterally of its axis and into said wire-receiving means and into the associated wire-admitting slot means whereby, wires can be connected to said conductors by supporting a downwardly facing surface of said ledge on a supporting anvil, locating said wires in alignment with said wire-receiving slot means, and moving said wires laterally of their axes, into said stalls, and into said wire-receiving slot means.

2. An electrical connector as set forth in claim 1, each of said plate-like means comprising a pair of plate members having upper ends which are connected by spaced-apart connecting strap members.

3. An electrical connector as set forth in claim 1, said housing having a plurality of openings extending therethrough from said adjacent external sidewall to said one internal sidewall to said plug-receiving opening, said openings being arranged in a row proximate to said plug-receiving end, said conductors extending through said openings.

4. An electrical connector as set forth in either of claims 1 or 2, said ledge and said rearward end having intersecting surfaces which extend normally of each other thereby to provide supporting surfaces for said connector when wires are inserted into said wire-receiving slot means of said conductors without imposition of stresses on critical portions of said housing.

* * * * *